US009441370B2

(12) United States Patent
Wolter et al.

(10) Patent No.: US 9,441,370 B2
(45) Date of Patent: Sep. 13, 2016

(54) FREE-STANDING WALL ARRANGEMENT AND METHODS

(71) Applicant: Anchor Wall Systems, Inc., Minnetonka, MN (US)

(72) Inventors: Robert Joel Wolter, Chanhassen, MN (US); Robert B. Burnquist, Chaska, MN (US); Harrison John Brown, Prior Lake, MN (US); Dale A. Buker, Brooklyn Park, MN (US); Jay J. Johnson, Star Prairie, WI (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 14/861,376

(22) Filed: Sep. 22, 2015

(65) Prior Publication Data

US 2016/0010328 A1 Jan. 14, 2016

Related U.S. Application Data

(63) Continuation of application No. 14/136,693, filed on Dec. 20, 2013, now Pat. No. 9,169,642, which is a continuation of application No. 13/600,481, filed on Aug. 31, 2012, now Pat. No. 8,677,711, which is a continuation of application No. 12/770,885, filed on Apr. 30, 2010, now Pat. No. 8,256,182.

(51) Int. Cl.
*E04C 1/39* (2006.01)
*E04C 1/00* (2006.01)
(Continued)

(52) U.S. Cl.
CPC ..... *E04C 1/395* (2013.01); *E04B 2/02* (2013.01); *E04B 2/46* (2013.01); *E04C 1/00* (2013.01);
(Continued)

(58) Field of Classification Search
CPC ..... E04C 1/395; E04C 1/40; E02D 29/025; E02D 17/205; E02D 9/004; E02D 2201/207
USPC ..... 52/596, 608, 609, 605, 593, 592.3, 52/592.5, 592.6; 405/284, 286, 576
See application file for complete search history.

(56) References Cited

U.S. PATENT DOCUMENTS 1,829,435 A 10/1931 Barnhart
2,921,462 A 1/1960 Wilson
(Continued)

FOREIGN PATENT DOCUMENTS

AT 009 651 U2 1/2008
DE 2815770 4/1978
(Continued)

OTHER PUBLICATIONS

IBStock Brick Design Guide brochure, Feb. 2001.
(Continued)

*Primary Examiner* — Brian Glessner
*Assistant Examiner* — Paola Agudelo
(74) *Attorney, Agent, or Firm* — Merchant & Gould P.C.

(57) ABSTRACT

A free-standing wall includes concrete base blocks adjacent to each other forming a base course; a first set of concrete wall blocks stacked on the base course and on each other to form a first wall face; and a second set of concrete wall blocks stacked on the base course and on each other to form a second wall face that faces the opposite direction from the first wall face and that has the same number of courses as the first plurality of wall blocks. Methods of constructing the wall arrangement include laying the base blocks next to each other end to end; stacking individual blocks of a first set of blocks on the base course and then on each other to form a first wall face; stacking individual blocks of the second set of blocks on the base course and then on each other to form a second wall face that faces a direction opposite of the first wall face.

17 Claims, 9 Drawing Sheets

(51) Int. Cl.
*E04B 2/46* (2006.01)
*E04B 2/02* (2006.01)

(52) U.S. Cl.
CPC *E04B 2002/0202* (2013.01); *E04B 2002/0258* (2013.01); *E04B 2002/0263* (2013.01); *E04B 2002/0269* (2013.01)

(56) References Cited

U.S. PATENT DOCUMENTS

| | | | | |
|---|---|---|---|---|
| 3,530,632 | A | 9/1970 | Sloan M. | |
| 4,312,164 | A | 1/1982 | Walt et al. | |
| 4,565,043 | A * | 1/1986 | Mazzarese | E04B 2/26 52/592.6 |
| 4,606,169 | A | 8/1986 | Noon et al. | |
| 4,993,206 | A | 2/1991 | Pardo | |
| 5,003,746 | A * | 4/1991 | Wilston | A63H 33/042 52/592.1 |
| 5,107,653 | A | 4/1992 | Lewis | |
| 5,154,032 | A * | 10/1992 | Ritter | E04H 17/1404 405/284 |
| 5,186,574 | A * | 2/1993 | Tavares | E01C 5/00 404/41 |
| 5,548,938 | A * | 8/1996 | Scheiwiller | E04B 2/18 405/286 |
| D378,423 | S * | 3/1997 | Henry | D25/114 |
| 5,651,642 | A | 7/1997 | Kelley, Jr. et al. | |
| 5,787,670 | A | 8/1998 | Muncy | |
| 5,820,305 | A | 10/1998 | Taylor et al. | |
| D416,627 | S | 11/1999 | McAllister | |
| 6,041,566 | A | 3/2000 | Allen | |
| D428,499 | S | 7/2000 | Bazzocchi | |
| 6,082,933 | A | 7/2000 | Maguire et al. | |
| 6,085,476 | A | 7/2000 | Jantzi et al. | |
| 6,112,489 | A | 9/2000 | Zweig | |
| 6,113,316 | A | 9/2000 | Ash | |
| D433,158 | S | 10/2000 | Hammer | |
| 6,161,357 | A | 12/2000 | Altemus | |
| D435,917 | S | 1/2001 | Hammer | |
| D466,228 | S | 11/2002 | Hammer | |
| D488,242 | S * | 4/2004 | MacDonald | D25/113 |
| 6,811,352 | B1 * | 11/2004 | Meerkerk | E02B 3/14 405/17 |
| 6,871,468 | B2 * | 3/2005 | Whitson | E02D 29/025 52/169.4 |
| 7,090,438 | B2 | 8/2006 | Price et al. | |
| 7,208,112 | B2 | 4/2007 | Scherer | |
| 8,256,182 | B2 | 9/2012 | Wolter et al. | |
| 8,677,711 | B2 | 3/2014 | Wolter et al. | |
| 9,169,642 | B2 | 10/2015 | Wolter et al. | |
| 2002/0026763 | A1 * | 3/2002 | Schmitz | A01G 1/08 52/605 |
| 2003/0182011 | A1 | 9/2003 | Scherer | |
| 2005/0066607 | A1 | 3/2005 | Hagenah | |
| 2007/0113510 | A1 | 5/2007 | Evereff | |
| 2009/0260314 | A1 | 10/2009 | Mugge et al. | |

FOREIGN PATENT DOCUMENTS

| | | |
|---|---|---|
| DE | 197 13 037 A1 | 10/1998 |
| EP | 2 148 019 A2 | 1/2010 |
| GB | 540561 | 10/1941 |
| GB | 2 018 854 | 4/1979 |

OTHER PUBLICATIONS

International Search Report and Written Opinion mailed Aug. 23, 2011.

* cited by examiner

FREE-STANDING WALL ARRANGEMENT AND METHODS

CROSS-REFERENCE TO RELATED APPLICATION

The present application is a continuation of U.S. Ser. No. 14/136,693, filed Dec. 20, 2013, which is a continuing application of U.S. Ser. No. 13/600,481, filed Aug. 31, 2012, which is a continuing application of U.S. Ser. No. 12/770,885, filed Apr. 30, 2010. A claim of priority is made to U.S. Ser. No. 13/600,481 and U.S. Ser. No. 12/770,885 to the extent appropriate. The complete disclosure of U.S. Ser. No. 13/600,481 and U.S. Ser. No. 12/770,885 are incorporated herein by reference.

TECHNICAL FIELD

This disclosure relates to concrete blocks that can be arranged into a free-standing wall. This disclosure also relates to the resulting free-standing wall, methods of constructing the wall, and the blocks used to construct the wall.

BACKGROUND

Concrete blocks can be used to create free-standing walls for landscaping or similar purposes. The blocks can be arranged to create the look of traditional stone walls. In some implementations, there will also be retaining walls made from blocks, and it is desirable to match the appearance of the free-standing walls with the retaining walls.

What is desired is blocks that can be used to form free-standing walls and that have a quick and simple installation with no cuts for making curved walls. It is also desired to have an attractive appearance on both sides of the wall.

SUMMARY OF THE DISCLOSURE

A free-standing wall arrangement is provided including a plurality of concrete base blocks arranged adjacent to each other to form a base course; a first plurality of concrete wall blocks stacked on the base course and on each other to form a first wall face having at least 2 courses; and a second plurality of concrete wall blocks stacked on the base course and on each other to form a second wall face that faces the opposite direction from the first wall face and that has the same number of courses as the first plurality of wall blocks.

In one example, each base block has first and second sides and first and second ends between the sides and a uniform first depth $D_1$ extending between the first and second sides. Each block of the first plurality of wall blocks has a uniform depth $D_2$ that is no greater than half of the first depth of $D_1$. The first plurality of wall blocks has at least one exposure face arranged to be along the first side of the base blocks to form the first wall face. Each block of the second plurality of wall blocks has the uniform second depth $D_2$ and at least one exposure face arranged to be along the second side of the base blocks to form the second wall face.

In another aspect, a method of building a free-standing wall is provided. The method includes laying a base course of concrete base blocks on a ground surface with the base blocks being arranged next to each other end to end. Next, there is a step of laying a plurality of courses of a first plurality of concrete wall blocks by stacking individual blocks of the first plurality on the base course and then on each other to form a first wall face. The first wall face is being formed by exposure faces of each block of the first plurality of wall blocks. There is also a step of laying a plurality of courses of a second plurality of concrete wall blocks by stacking individual blocks of the second plurality on the base course and then on each other to form a second wall face that faces the opposite direction from the first wall face. The second wall face is formed by exposure faces of each block of the second plurality of wall blocks.

In another aspect, a concrete base block is provided. The base block includes a first rounded convex end and an opposite second rounded concave end having the same radius of curvature as the first end. First and second sides extend between the first and second ends. There is a top face and an opposite bottom face between the first and second ends and the first and second sides. A through-core arrangement extends completely through the block from the top face to the bottom face. The through-core arrangement has first and second edges parallel to the first and second sides. A plurality of recessed pockets are in the bottom face. First and second hand-receiving indents are in the bottom face and along the first and second sides and are sized to accommodate at least a few fingers of a human hand.

DETAILED DESCRIPTION

A. Overview

Figure 1:
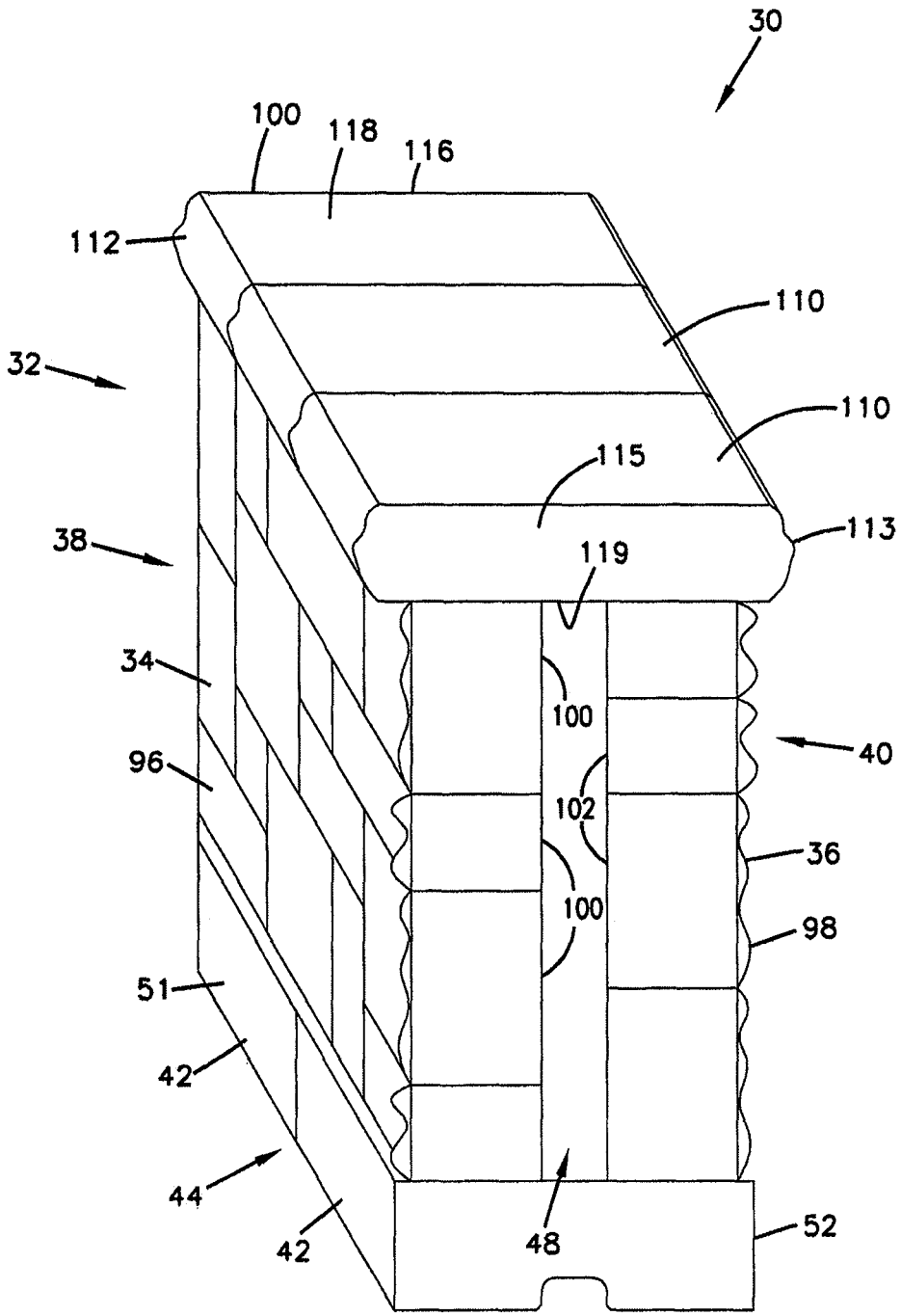
FIG. 1 is a schematic, perspective view of one embodiment of a free-standing wall, constructed in accordance with the principles of this disclosure.

A free-standing wall constructed in accordance with the principles of this disclosure is shown in FIG. 1 at 30. The wall 30 is constructed and arranged from a plurality of blocks 32 and will result in a self-supporting structure that can be used in landscaping, for example. The wall 30 has a first wall face 34 and an opposite facing second wall face 36. As can be appreciated by the view shown in FIG. 1, the first wall face 34 is formed from a first plurality of wall blocks 38, while the second wall face 36 is formed from a second plurality of wall blocks 40. In general, the blocks forming the wall 30 are preferably made from dry cast concrete, but they may also be made from wet cast concrete.

The free-standing wall 30 includes a plurality of base blocks 42. The base blocks 42 are provided to form the foundation of the wall 30. As such, the base blocks 42 are placed on the ground upon which the wall 30 is being constructed. The base blocks 42 are arranged adjacent to each other, end to end, to form a base course 44 of the wall 30. It is upon the base course 44 that the first plurality of wall blocks 38 and the second plurality of wall blocks 40 are stacked to form the respective first wall face 34 and second wall face 36.

Figure 2:
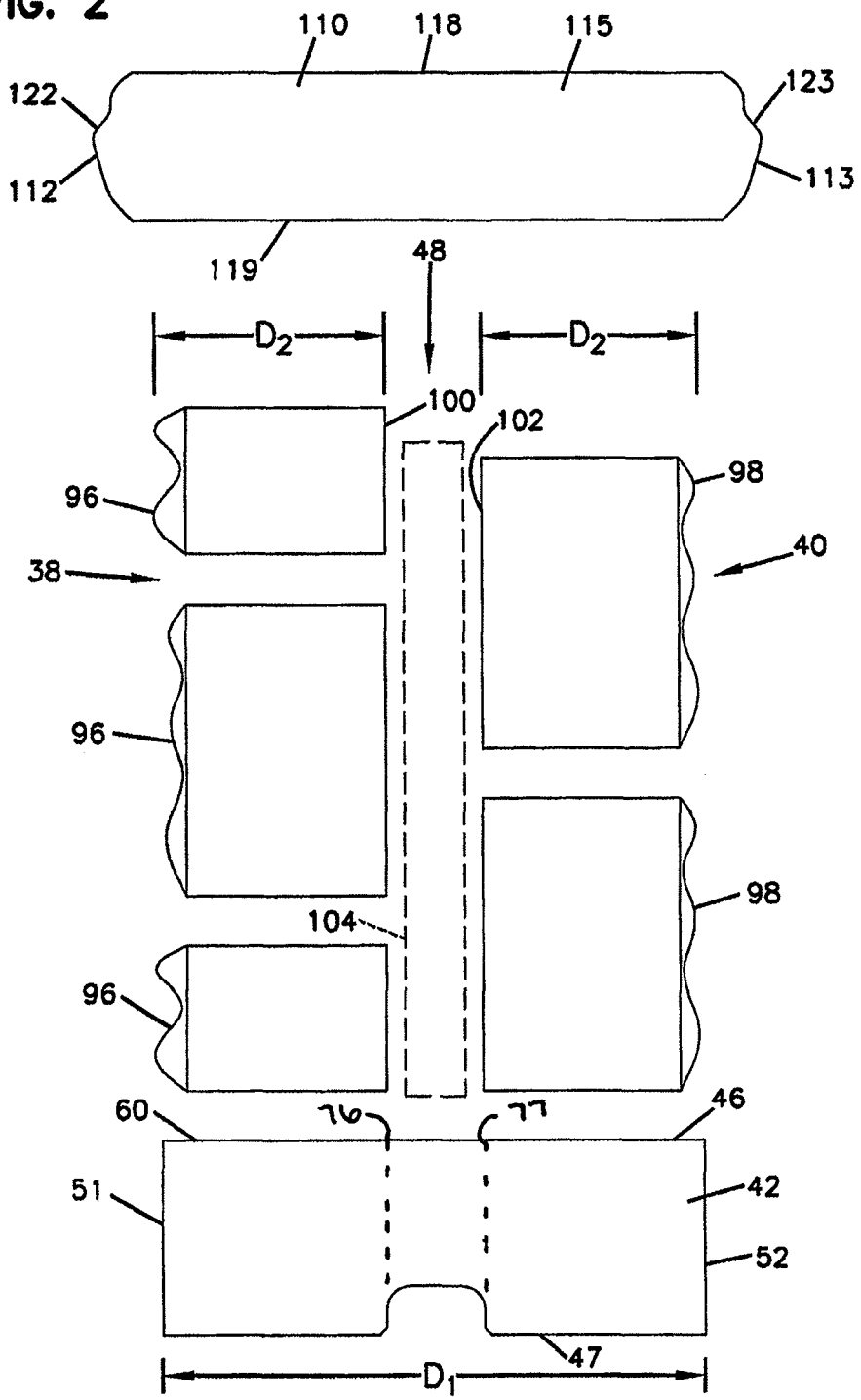
FIG. 2 is an exploded, side view of the free-standing wall of FIG. 1.

As can be seen in FIG. 2, the base blocks 42 have a first depth $D_1$, while the blocks that form the first plurality of wall blocks 38 and the blocks that form the second plurality of wall blocks 40 have a second depth $D_2$ that is no greater than half of the first depth $D_1$. In this manner, both of the first plurality of wall blocks 38 and the second plurality of wall blocks 40 are able to fit on the top face 46 of the base block 42. It can be seen in FIG. 2 that in the embodiment shown, the depth of $D_2$ is less than half of the first depth $D_1$, resulting in a gap 48 between the first plurality of wall blocks 38 and the second plurality of wall blocks 40.

B. Embodiment of Base Blocks 42

Referring now to FIGS. 8-12, one example embodiment of the base block 42 is depicted. The base block 42 has first and second sides 51, 52. The first and second sides 51, 52 define a height of the base block 42. In one embodiment, the height of the base block 42 is about 4 inches, preferably greater than 3.8 inches and preferably no greater than 6 inches.

Figure 12:
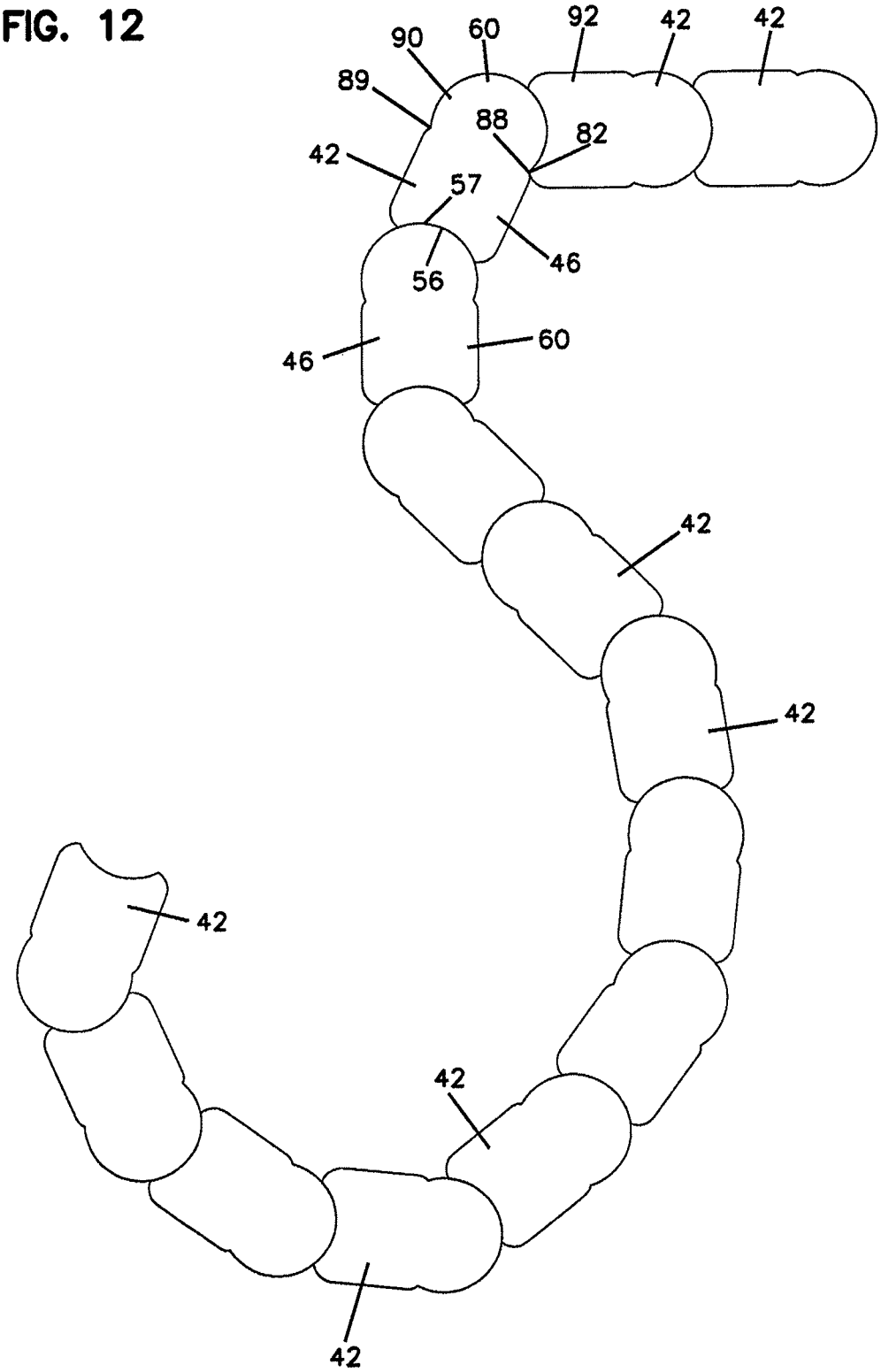
FIG. 12 is a schematic, top view of outlines of the base blocks of FIG. 8 depicting how the base blocks may be arranged to form curves or serpentine sections.

Between the first and second sides 51, 52 are first and second ends 54, 55. In preferred embodiments, the first end 54 is a rounded convex end 56, while the second end 55 is a rounded concave end 57. In preferred embodiments, the convex end 56 and concave end 57 have the same radius of curvature, such that the base blocks 42 may be arranged next to each other with the first rounded convex end 56 fitting within the second rounded concave end 57. An example is shown in FIG. 12, in which several base blocks 42 are arranged adjacent to each other first end 54 to second end 55. FIG. 12 shows only the outside border of the base blocks 42, for purposes of clarity of illustration.

The shape of the first end 54 and second end 55 allows for the base blocks 42 to be arranged in a curved or serpentine pattern, as well as in a straight line. As such, the wall 30 can be formed to be straight, curved, or serpentine. In preferred embodiments, the radius of curvature of the convex end 56 and the concave end 57 is at least 5 inches, no greater than 6 inches, and preferably about 5.5 inches.

Between the first and second ends 54, 55 and the first and second sides, 51, 52 are the top face 46 and an opposite bottom face 47. In general, the top face 46 is flat forming a platform 60 to receive the first plurality of wall blocks 38 and the second plurality of wall blocks 40. The bottom face 47 faces and is against the ground.

In the preferred embodiment, the bottom face 47 includes a plurality of recessed pockets 62. The pockets 62 permit the ground to be received within the pockets 62 and help to anchor or secure the base block 42 to the ground.

While a variety of implementations are possible, in the example shown, the pockets 62 include 4 cavities 64, each cavity 64 being in one quadrant of the base block 42. The cavities 64 have a circular shape, but could be any shape. The cavities 64 have a depth of about 0.375 inches, and will generally be greater than 0.25 inch and no greater than 0.5 inch. The cavity 64 allows for gravel or sand from the ground to embed and help to lock and secure the base block 42 to the ground.

Preferably, the base block 42 further includes at least one hand-receiving indent 66 in the bottom face 47. The hand-receiving indent 66 is sized to accommodate at least a few fingers of a human hand and is provided to assist the user in movement and manipulation of the base block 42. While a number of variations are contemplated, in the embodiment shown, there are 2 hand receiving indents 66, one located along each of the first and second sides 51, 52 and generally centered between the first end 54 and second end 55. The hand-receiving indents 66 allow a user to insert his fingers underneath the base block 42 when it is face down on the ground. The user's fingers can slide into the space provided by the indent 66, and the user then can move the base block 42 around. The hand-receiving indent 66 may have a height of about 0.625 inches, and be at least 0.5 inches and no greater than 2 inches.

Figure 8:
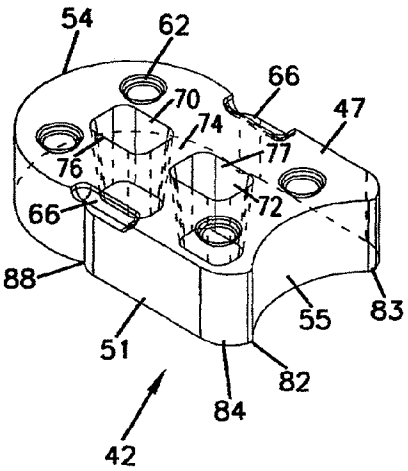
FIG. 8 is a perspective view of one of the base blocks useable in the free-standing wall of FIG. 1, the view showing the bottom of the base block.
Figure 11:
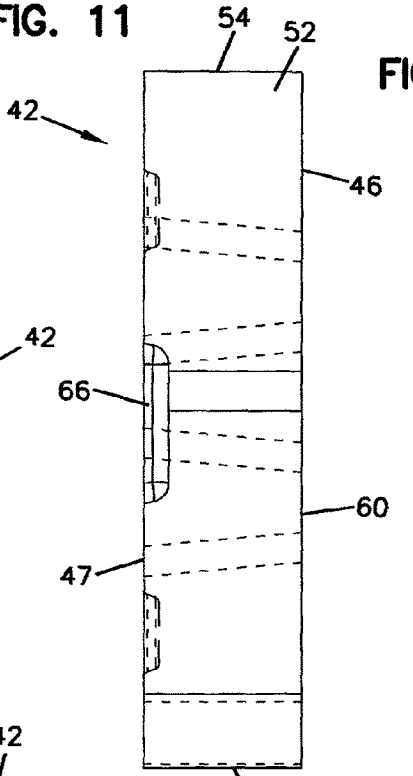
FIG. 11 is a side view of the base block of FIG. 9.
Figure 9:
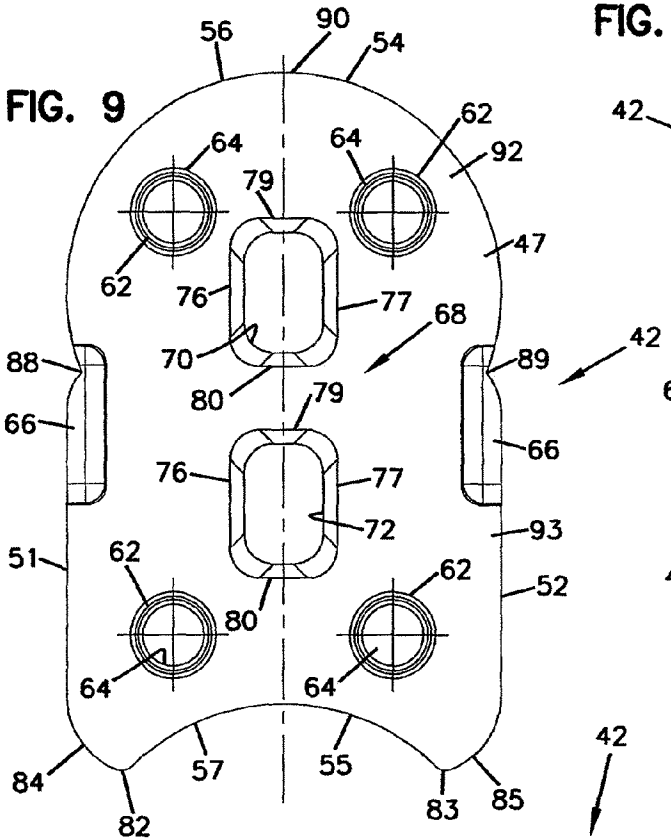
FIG. 9 is a top view of the base block of FIG. 8, the view showing the bottom of the base block.
Figure 10:
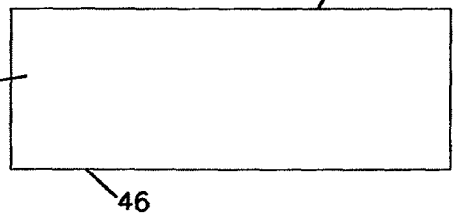
FIG. 10 is an end view of the base block of FIG. 9.

Referring now to FIGS. 8 and 9, the base block 42 shown in this embodiment has a through-core arrangement 68 extending completely through the block 42 from the top face 46 to the bottom face 47. The through-core arrangement 68 helps to result in a lighter weight block 42, and it also provides other helpful features. For example, in the embodiment shown, the core arrangement 68 includes first and second cores 70, 72. The first and second cores 70, 72 are generally centered between the first and second sides 51, 52 and are symmetrical with respect to the location between the first and second ends 54, 55. The first and second cores 70, 72 are sized to accommodate a human hand and form hand holds for the block 42. That is, a user can put one of his hands in one of the first and second cores 70, 72, and his other hand in the other of the cores 70, 72 to grasp the block portion 74 between the first and second cores 70, 72 to move and carry the block.

The core arrangement 68 including the first core 70 and second core 72 have first and second edges 76, 77 that are preferably parallel to the first and second sides 51, 52, respectively. Between the first and second edges 76, 77 are third and fourth edges 79, 80, such that each of the first core 70 and second core 72 is generally rectangular in shape. The third and fourth edges 79, 80 need not be straight, but can be a variety of shapes; they are just shown straight in this embodiment as an example. The first and second edges 76, 77 being parallel to the first and second sides 51, 52 is helpful in forming a guide for the arrangement of the first plurality of wall blocks 38 and second plurality of wall blocks 40 on the base blocks 42. This is explained more fully below.

Still referring to FIGS. 8 and 9, as mentioned above, the base block second end 55 is rounded and concave. In this embodiment, the rounded section 57 is contained within a pair of tips 82, 83. Between the first side 51 and the tip 82 is a rounded corner 84, while between the second side 52 and the tip 83 is a rounded corner 85. The corners 84, 85 are on a radius of about 2 inches, generally at least one inch and not greater than 3 inches. The tips 82, 83 in cooperation with the concave end 57 help to form sharper turns when arranging the base blocks 42 in a curved form. Specifically, for example, the base block 42 shown also includes an indent 88 along the first side 51, and an indent 89 along the second side 52. The indents 88, 89 are generally located nearest the center of gravity of the block 42. This location makes handling of the block 42 easier when installing. The indents 88, 89 are shaped to receive the tips 82, 83 of an adjacent base block 42 when forming a corner. An example can be seen in FIG. 12 between blocks 90 and 92. In this example, the tip 82 of the block 92 is received within the indent 88 of the block 90.

While a variety of shapes and dimensions can be used, in one preferred embodiment, the base block 42 has a length between the tips 82, 83 and center bight 90 of the convex end 56 of about 17.5 inches, at least 6 inches, and no greater than 38 inches. The width of the base block 42 between first side edge 51 and second side edge 52 is about 11 inches, at least 8 inches and no greater than 36 inches. The width of each of the cores of the through core arrangement 68 between the first and second edges 76 and 77 is about 2 inches, at least about 1 inch, and no greater than 6 inches. The length of each of the cores of the through core arrangement 68 between the third edge 79 and fourth edge 80 is about 3 inches, at least one inch, and no greater than 6 inches. Each of the hand receiving indents 66 has an overall length in the direction from the block second end 55 to the block first end 54 of about 4 inches, at least about 2 inches, and no greater than 10 inches. The width of each of the hand receiving indents 66 from each of the respective first and second sides 51, 52 is about 1 inch, at least 0.5 inches, and no greater than 3 inches. In general, the hand receiving indents 66 have a generally rectangular shape in appearance, except where the indents 88, 89 protrude within the hand receiving indents 66.

In the embodiment shown, the base block 42 can be divided into 2 regions, 92, 93. The regions 92, 93 are divided by the side indents 88, 89. Region 92 is the region between the side indents 88, 89 and the first end 54. In the embodiment shown, region 92 has a general shape from the top or bottom view of a truncated circle; that is, a circle that has been cut off in a region below the diameter. The region 93 is the region between the side indents 88, 89 and the second end 55. Region 93 has an appearance of a rectangle with a pair of jutting tails formed by the tips 82, 83.

C. Embodiments of First and Second Wall Faces 34, 36

Referring again to FIGS. 1 and 2, the first plurality of wall blocks 38 and second plurality of wall blocks 40 are stacked on the base course 44 of the base blocks 42 to form the wall 30.

In general, each block of the first plurality of wall blocks 38 has at least one exposure face 96 that is arranged to be along the first side 51 of the base block 42. Each of the exposure faces 96 of the first plurality of wall blocks 38 forms the first wall face 34. By the term "exposure face" it is meant the portion of the first plurality of wall blocks 38 that is not covered by or directly against another block forming the wall 30. In general, the exposure face 96 would be a portion of the wall 30 that is openly visible. In many preferred implementations, the exposure face 96 is textured, patterned, or otherwise molded with a topographical definition (3-dimensional pattern). The relief on the exposure face 96, measured from the lowest point to the highest point, is preferably at least 0.5 inches, and more preferably at least 1.0 inch. The greatest relief at any place across the exposure face 96 is the maximum relief, and the maximum relief of the exposure face 96 is at least about 0.5 inches.

Similarly, each block of the second plurality of wall blocks 40 has at least one exposure face 98 arranged to be along the second side 52 of the base blocks 42 to form the second wall face 36.

As can be seen in the embodiment of FIGS. 1 and 2, each block of the first plurality of wall blocks 38 includes a rear face 100 that is opposite the exposure face 96. Similarly, each block of the second plurality of wall blocks 40 has a rear face 102 that is opposite the exposure face 98. The rear faces 100, 102 of the first and second plurality of wall blocks 38, 40 are spaced apart from each other, in the preferred embodiment, to form a gap 48 therebetween. In some embodiments, the gap 48 can be optionally filled with an aggregate filler 104, shown in phantom lines in FIG. 2. The aggregate filler 104 can be clear rock with no fines, such as 0.5 inch clear rock. It may also be a stabilized aggregate. The aggregate filler 104 helps to prevent the individual blocks forming the first and second wall faces 34, 36 from being moved into the gap 48.

When the blocks of the first plurality of wall blocks 38 is stacked on the top face 46 of the base blocks 42, the through-core arrangement 68 functions as a guide. Specifically, the rear face 100 of each of the blocks of the first plurality of wall blocks 38 is aligned with one of the first edges 76 of either the first core 70 or second core 72. This helps to arrange the first plurality of wall blocks 38 into the same alignment as the base blocks 42. Similarly, the rear face 102 of each of the second plurality of wall blocks is aligned with one of the second edges 77 of the first core 70 or second core 72 of the base blocks 42 to help guide the location of the second plurality of wall blocks 40 properly on the base course 44.

When forming the wall 30, adhesive is applied between the courses of the first plurality of wall blocks 38 and the second plurality of wall blocks 40. The adhesive secures each individual block in the wall 30. The adhesive can be a concrete adhesive such as PL Premium, a polyurethane construction adhesive.

D. Cap Blocks

As can be seen in FIGS. 1 and 2, the wall 30 may include a plurality of cap blocks 110. Each cap block 110 covers and extends beyond the faces of both the first and second plurality of wall blocks 38, 40 and covers the gap 48 between the first plurality of wall blocks 38 and the second plurality of wall blocks 40.

In preferred embodiments, each cap block 110 has opposite front and rear faces 112, 113; opposite first and second sides 115, 116 between the front and rear faces 112, 113; and opposite top and bottom faces 118, 119 between the front and rear faces 112, 113 and first and second sides 115, 116.

The cap blocks 110 are arranged adjacent to each other along the first and second sides 115, 116 and on top of the first and second plurality of wall blocks 38, 40 such that each cap block 110 has its bottom face 119 against respective top faces of the blocks in the top course of the first plurality of wall blocks 38 and second plurality of wall blocks 40. This also results in the front face 112 of each cap block being along the first wall face 34, and the rear face 113 of each cap block 110 being along the second wall face 36.

In preferred embodiments, the front face 112 and rear face 113 are textured, patterned, have a topographical definition, or a three-dimensional pattern. In addition, the cap blocks can be formed such that when they are side by side, they have a seamless appearance in that each profile 122, 123 of the front face 112 and rear face 113 is a mirror image of the next adjacent cap block 110. As such, these cap blocks can be formed as described in commonly assigned and co-pending U.S. patent application Ser. No. 12/105,902, filed Apr. 18, 2008, incorporated herein by reference.

E. Blocks Used to Form Wall 30

In preferred embodiments, the wall 30 will provide an attractive appearance, utilizing a variety of blocks. In addition to the base block 42 and the cap blocks 110, one preferred implementation includes using six different block sized for constructing the first and second wall faces 34, 36. Of course, other embodiments can use more or fewer block sizes.

In FIGS. 4-7, 15 and 16, the blocks are shown generally at 130. Each of the blocks 130 has an exposure face 132, which is either the exposure face 96 or exposure face 98, as depicted in FIGS. 1 and 2. In preferred embodiments, the blocks are made of dry cast concrete and the exposure face 132 has a three-dimensional pattern. The three-dimensional pattern can be made as described in commonly assigned U.S. Pat. No. 7,208,112, incorporated herein by reference. In many preferred embodiments, the three-dimensional pattern has a topographical definition that has a relief of at least 0.5 inch.

Each of the blocks 130 includes a rear face 134 that is on the opposite side of the block 130 from the exposure face. In FIGS. 1 and 2, the rear face 134 is shown as either rear face 100 or rear face 102. In between the exposure face 132 and rear face 134 are top and bottom faces 136, 137 and first and second sides 138, 139. In preferred embodiments, each of the rear face 134, top face 136, bottom face 137, first side 138, and second side 139 is planar, untextured, and generally two-dimensional.

In preferred embodiments, at least some of the blocks 130 include at least one of the first and second sides 138, 139 is at a non-orthogonal angle relative to the exposure face 132 and rear face 134. In these embodiments, the rear face 134 is shorter than the exposure face 132. This shape, including the shorter length of the rear face 134 than the exposure face 132 allows the blocks 130 to be arranged relative to each other in a way that allows them to be formed into curves or serpentine shapes. For example, the blocks 130 shown in FIGS. 4-7 include the rear face 134 being shorter than the exposure face 132.

Figure 16A:
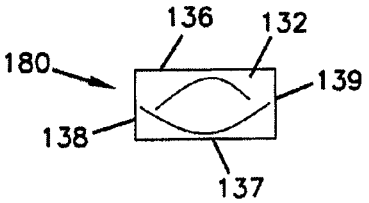
FIG. 16A is a front view of another of the blocks used in the free-standing wall of FIG. 1.
Figure 16A:
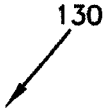
Figure 16B:
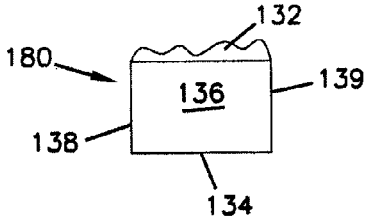
FIG. 16B is a top view of the block of FIG. 16A.
Figure 16C:
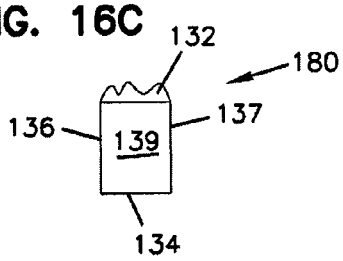
FIG. 16C is an end view of the block of FIGS. 16A and 16B.

One useful block is shown in FIGS. 16A-16C at 180. In FIG. 16A, the exposure face 132 has a first length $L_1$ between the first side 138 and the second side 139. The block 180 has a height between the top face 136 and bottom face 137 that is a first height $H_1$. In one example embodiment, the length $L_1$ is about 6 inches, and the first height $H_1$ is about 3 inches. Of course, other dimensions can be used. The block 180 has both its first side 138 and second side 139 being orthogonal relative to the exposure face 132 and rear face 134.

Figure 15A:
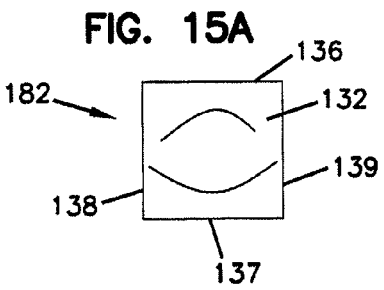
FIG. 15A is a front view of another of the blocks used in the free-standing wall of FIG. 1.
Figure 15A:
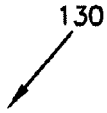
Figure 15B:
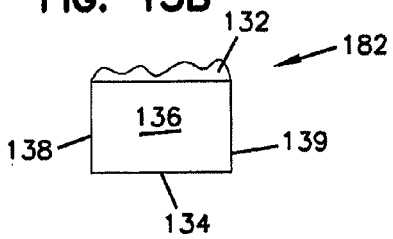
FIG. 15B is a top view of the block of FIG. 15A.
Figure 15C:
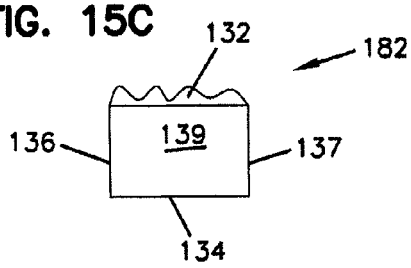
FIG. 15C is an end view of the block of FIGS. 15A and 15B.

Another useful block is shown in FIGS. 15A-15C at 182. In FIGS. 15A, the exposure face 134 has the first length $L_1$ between the first side 138 and the second side 139. The block 182 has a height between the top face 136 and bottom face 137 that is a second height $H_2$. In preferred embodiments, the second height $H_2$ is twice the height of the first height $H_1$. In one example embodiment, the height $H_2$ is about 6 inches. Of course, other dimensions can be used. The block 182 has both the first side 138 and second side 139 orthogonal relative to the exposure face 132 and rear face 134.

Figure 7A:
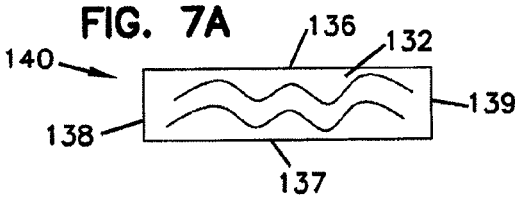
FIG. 7A is a front view of another of the blocks useable in the free-standing wall of FIG. 1.
Figure 7A:
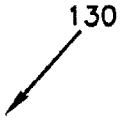
Figure 7B:
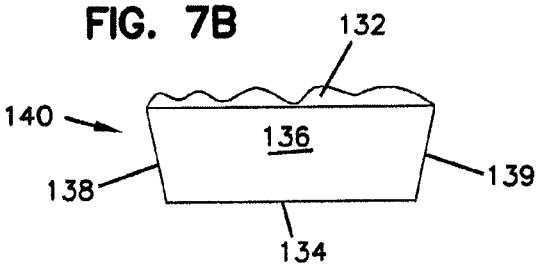
FIG. 7B is a top view of the block of FIG. 7A.
Figure 7C:
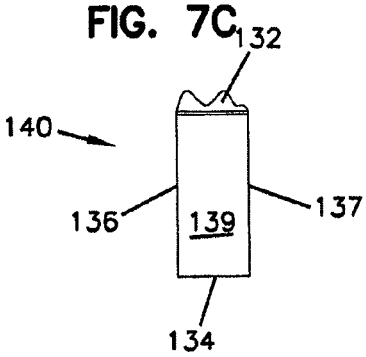
FIG. 7C is an end view of the block of FIGS. 7A and 7B.

Another useful block is shown in FIGS. 7A-7C at 140. In FIG. 7A, the exposure face 132 has second length $L_2$ between the first side 138 and second side 139. Again, referring to FIG. 7A, the first block 140 has a height between the top face 136 and bottom face 137 that is the first height $H_1$. In one example embodiment, the length $L_2$ is about 12 inches, and the first height $H_1$ is about 3 inches. Of course, other dimensions can be used. The block 140 has both the first side 138 and second side 139 tapered or angled relative to the exposure face 132.

Figure 6A:
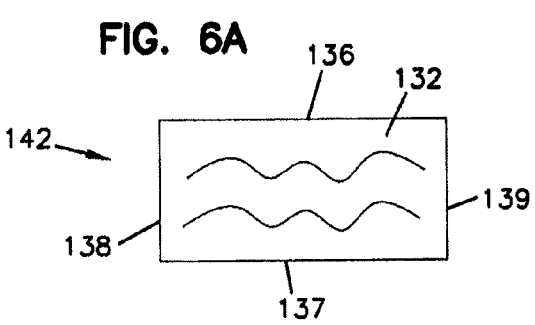
FIG. 6A is a front view of another of the blocks useable in the free-standing wall of FIG. 1.
Figure 6A:
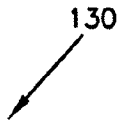
Figure 6B:
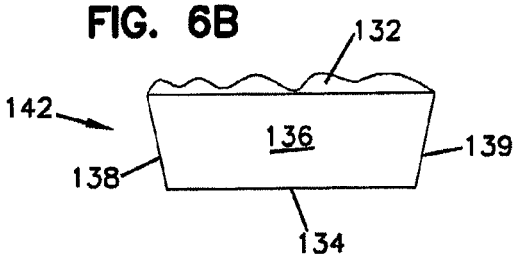
FIG. 6B is a top view of the block of FIG. 6A.
Figure 6C:
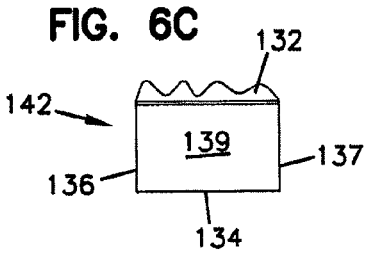
FIG. 6C is an end view of the block of FIGS. 6A and 6B.

A second useful block is shown at 142 in FIGS. 6A-6C. The second block 142 has its first side 138 and second side 139 angled non-orthogonally relative to the exposure face 132 and rear face 134. In reference to FIG. 6A, the block 142 has a length between the first side 138 and second side 139 of the second length $L_2$. That is, the length of the block 142 between the first and second sides 138, 139, is the same as the length $L_2$ between the first and second sides 138, 139 of the first block 140. The height of the second block 142 between the top face 136 and bottom face 137 is a second height $H_2$. In preferred embodiments, this second height $H_2$ is twice the height of the first height $H_1$. As such, the second block 142 is twice the height of the first block 140.

Figure 5A:
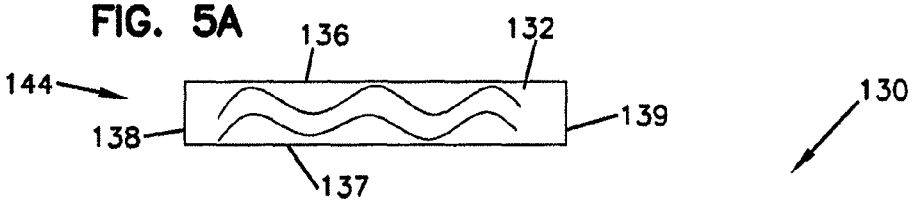
FIG. 5A is a front view of another of the blocks useable in the free-standing wall of FIG. 1.
Figure 5B:
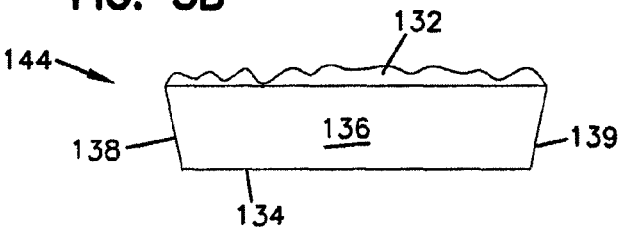
FIG. 5B is a top view of the block of FIG. 5A.
Figure 5C:
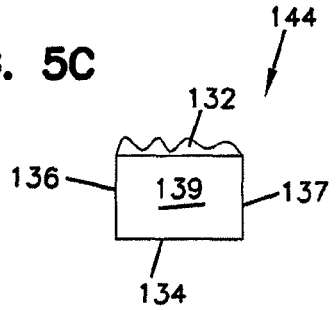
FIG. 5C is an end view of the block of FIGS. 5A and 5B.

In reference now to FIGS. 5A-5C, a third useful block is shown at 144. The third block 144 includes both the first side 138 and second side 139 as being at a non-orthogonal angle relative to the exposure face 132 and rear face 134. As such, the first and second sides 138, 139 of the third block 144 are tapered and angled from the longer exposure face 132 in a direction toward the shorter rear face 134.

The third block 144 includes a third length $L_3$ between the first side 138 and second side 139 that is three-times the first length $L_1$. That is, the length of the third block 144 is three-times the length $L_1$ of the blocks 180, 182.

The third block 144 includes height $H_1$, which is between the top face 136 and bottom face 137. The height $H_1$ is the same first height as the height of the first block 140, and it is half of the height $H_2$ of the second block 142.

Figure 4A:
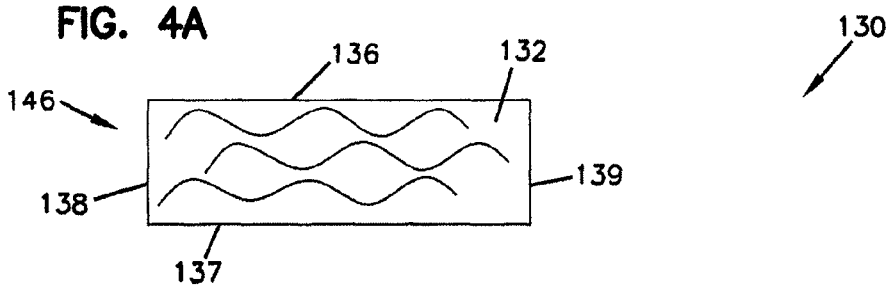
FIG. 4A is a front view of one of the blocks useable in the free-standing wall of FIG. 1.
Figure 4B:
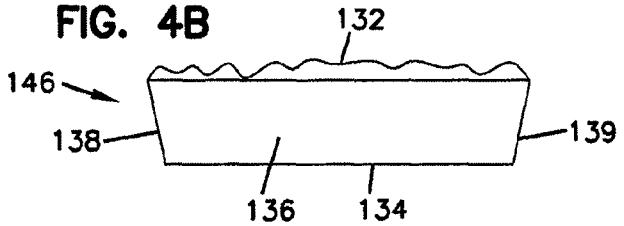
FIG. 4B is a top view of the block of FIG. 4A.
Figure 4C:
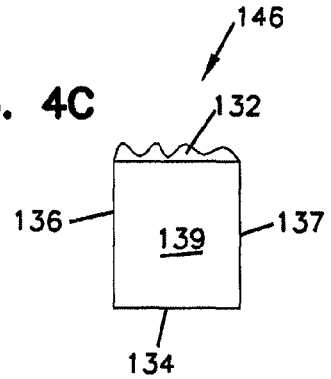
FIG. 4C is an end view of the block of FIGS. 4A and 4B.

In FIGS. 4A-4C, another useful block that can be used in the wall 30 is shown at 146. The fourth block 146 has both the first and second sides 138, 139 at a non-orthogonal angle relative to the exposure face 132 and rear face 134. As such, both the first and second sides 138, 139 are angled, tapered from the exposure face 132 to the shorter rear face 134.

The fourth block 146 has third length $L_3$ between the first side 138 and second side 139, which is three-times the length $L_1$. Thus, the fourth block 146 has a length that is the same as the third block 144 and three-times the length of block 182 and block 182.

The fourth block 146 has height $H_2$, which is twice the height of first height $H_1$, which is the same as the second block 142 and twice that of the first block 140 and third block 144 and block 180.

F. End Construction, FIGS. 13 and 14

Figure 14:
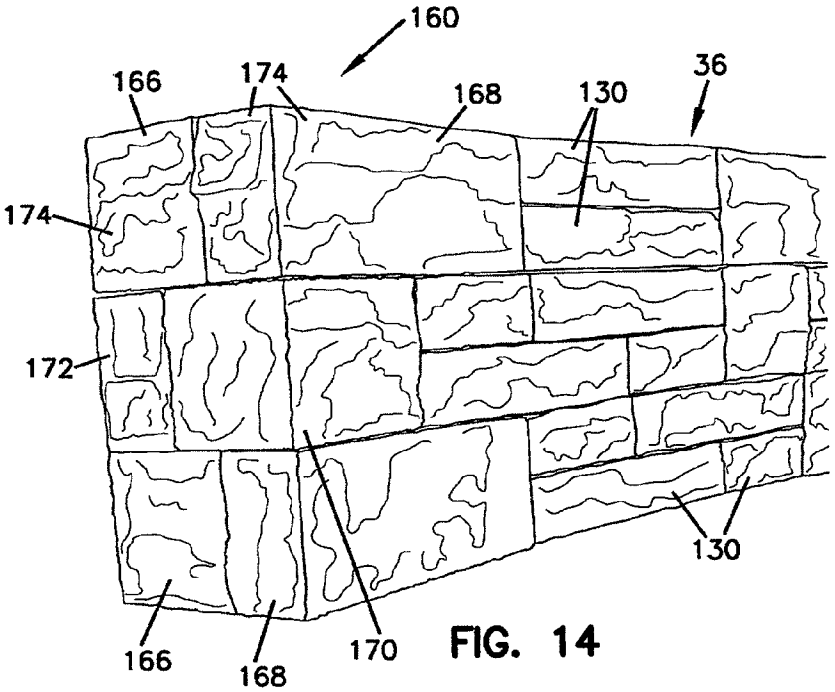
FIG. 14 is another perspective view showing the end section of the free-standing wall of FIG. 13.
Figure 13:
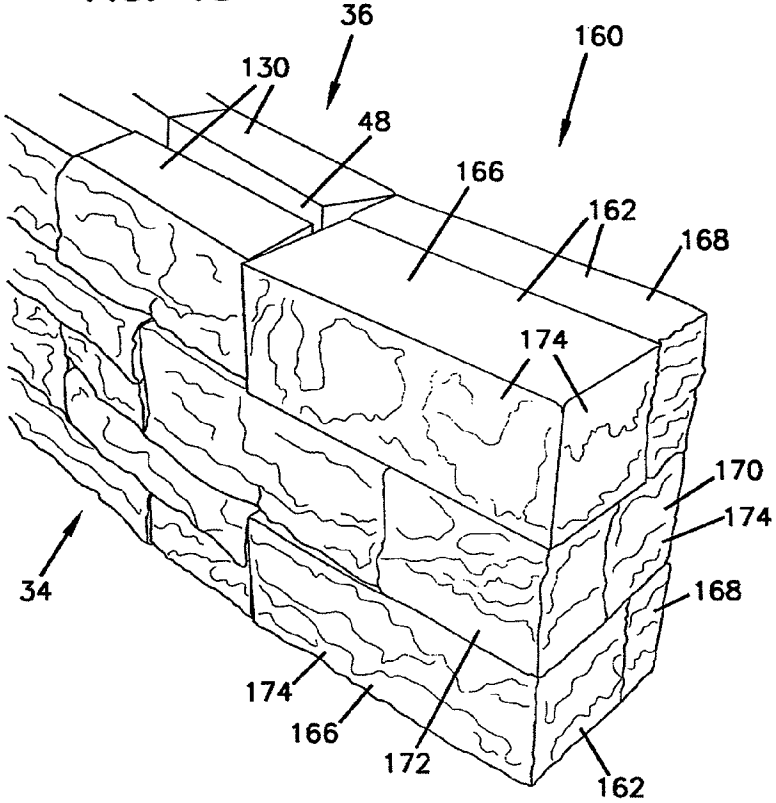
FIG. 13 is a schematic, perspective view showing an end section of a free-standing wall, constructed in accordance with principles of this disclosure.

Referring now to FIGS. 13 and 14, an embodiment of an end construction for the wall 30 is illustrated. One of the objectives of the end construction is to have an easy, convenient construction that integrates well with the rest of the wall 30, and which covers the gap 48. It also avoids creating a visual, vertical seam up the wall 30.

An embodiment of an end construction is shown in FIGS. 13 and 14 at 160. The end construction 160 utilizes blocks 162 that preferably have the same face pattern or style as those of the blocks 130 in the first wall face 34 and second wall face 36. In general, the blocks 162 have an overall length that is the same as the second length $L_2$ and a height that is the second height $H_2$. The depth of each of the blocks 162 is a depth that can be adjusted by cutting such that two of the blocks 162 can be oriented back to back with their faces aligned with the first and second wall faces 34, 36 while closing the gap 48. The blocks 62 can have their length $L_2$ cut in half, so that some of the blocks 162 have the first length $L_1$.

In the embodiment illustrated in FIGS. 13 and 14, the end construction 160 uses six blocks 162. The blocks 162 will be one of four different dimensions. Each of the blocks 162 has the second height $H_2$. A first end block is shown at 166. First end block 166 has the second length $L_2$ and a depth $D_3$. A second of the end blocks is shown at 168. Second end block 168 has the second length $L_2$ and a depth $D_4$. Together, the depth $D_3$ and the depth $D_4$ add together to have a total depth that is sufficient to cover the ends of the first and second wall faces 134, 136 and the gap 48 in between.

A third end block is shown at 170. The third end block 170 has the first depth $D_3$ and the first length $L_1$. That is, the third end block 170 is half the length of the first end block 166 and second end block 168. The depth $D_3$ of third end block 170 is the same as the depth of the first end block 166.

A fourth end block 172 has the first length $L_1$ and the depth $D_4$. As such, the third and fourth end blocks 170, 172 are of the same length, and their respective depths add up to a total depth that covers the ends of the first and second wall faces 134, 136 as well as the gap 48.

In the arrangement shown in FIGS. 13 and 14, the first and second end blocks 166, 168 would be oriented on the base course 44 (not shown in FIGS. 13 and 14). The blocks 166, 168 are oriented back to back. On top of the first and second end blocks 166, 168 are the third and fourth end blocks 170, 172. The third and fourth end blocks 170, 172 are oriented back to back. On top of the third and fourth end blocks 170, 172 are the first and second end blocks 166, 168, oriented back to back.

As can be seen in FIGS. 13 and 14, the blocks 162 have at least two exposure faces 174 that are orthogonal to each other, such that the blocks 162 can form the ends of the wall 30. In some embodiments, the blocks 162 will include four or more exposure faces 174, for convenience and versatility.

The blocks 162 can all be blocks of identical dimensions that are then cut to shape for use in the wall 30. For example, the third and fourth end blocks 170, 172 can be cut to the first length $L_1$ by taking a block 162 and cutting it in half. The depth $D_3$ and $D_4$ can be formed by taking a block and then cutting it to the desired depth of either $D_3$ or $D_4$. In some embodiments, there will be score marks on either the top face or bottom face of the blocks 162 to show the depth $D_3$ and the depth $D_4$ for ease of cutting by the installer of the wall.

In one example embodiment, the depth $D_3$ is 6 inches, while the depth $D_4$ is 3.5 inches. The length $L_1$ is 8 inches, while the length $L_2$ is 16 inches.

After forming the end construction 160, one or more cap blocks 110 may be placed on top of the end construction 160 to finish the appearance. Adhesive can be used between the blocks 162 of the end construction 160.

G. Method of Constructing Wall 30

A method of building a free-standing wall, such as wall 30, can utilize the blocks and principles described above.

First, the base course 44 is laid on the ground. This is done by using base blocks 42 and lining them up or arranging them next to each other end to end. The first end 54 of one base block 42 is placed next to the second end 55 of another of the base block 42. Specifically, the rounded convex end 56 of the first end 54 is placed within the rounded concave end 57 of the adjacent base block 42. The base blocks 42 can be arranged in curves or serpentine patterns, such as shown in FIG. 12.

Figure 3:
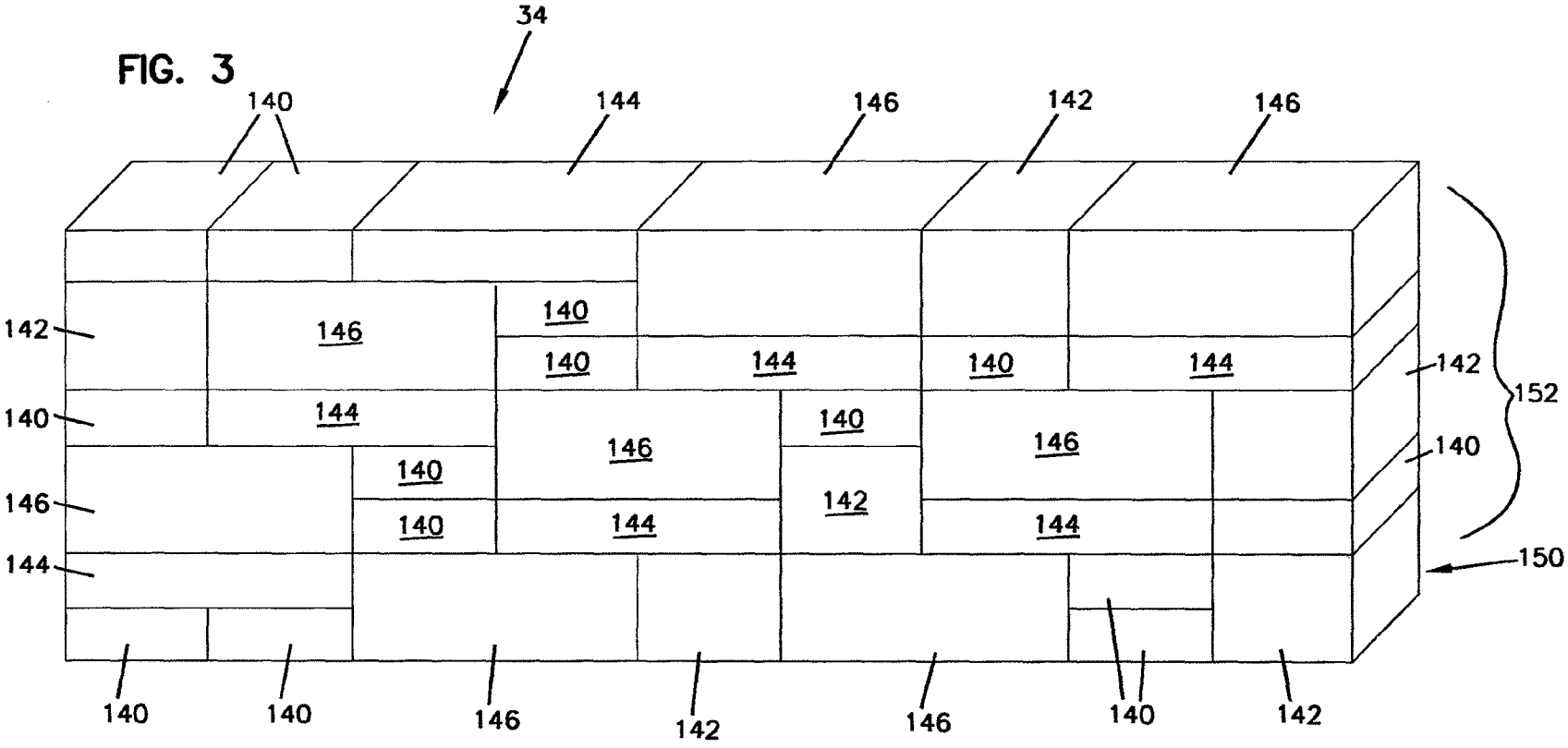
FIG. 3 is a perspective view of one embodiment of one of the wall faces that can be used in the free-standing wall of FIG. 1.

After the base course 44 is placed, a plurality of courses of the first plurality of wall blocks 38 is laid. The plurality of courses are laid by stacking individual blocks 130 of the first plurality of wall blocks 38 on the base course 44 and then on each other to form the first wall face 34. One example of a first wall face 34 is shown in FIG. 3. The wall face 34 of FIG. 3 is an example embodiment different from the example embodiment of the wall face 34 of FIG. 1.

In FIG. 3, the first course is shown at 150. FIG. 3 omits, for purposes of clarity, the base course 44. The first course 150 depicted in FIG. 3 is just one example of many different arrangements. In FIG. 3, the first course 150 includes, from left to right, as shown in FIG. 3, a pair of first blocks 140 arranged adjacent to each other. Next to the first block 140 is fourth block 146, followed by second block 142, then fourth block 146, then first block 140, and finally second block 142. After the first course 150 is formed, then one or multiple further courses 152 may be formed on top of the first course 150. Because of the preferred dimensions of the block 130, the resulting wall face 134 has evenness, but still provides the visual appearance of a generally random pattern. In between the courses, adhesive can be used to secure the block 130 on top of the adjacent block below it.

The method also includes forming a plurality of courses of the second plurality of wall blocks 40 by stacking individual blocks 130 of the second plurality 40 on the base course 44 and then on each other to form the second wall face 36. The second wall face 36 will face a direction that is opposite of the first wall face 34, such as shown in FIG. 1. The second wall face 36 is formed in an analogous fashion as the first wall face 34 as shown in FIG. 3. However, it should be understood that the second wall face 36 can have a different arrangement of blocks 130, from the first wall face 134.

The step of laying a plurality of courses of the first plurality of wall blocks 38 and laying a plurality of courses of the second plurality of wall blocks 40 may be done "simultaneously." By the term "simultaneously," it is meant that one block 130 can be laid to form the first wall face 34, and then the second block 130 can be laid to form the second wall face 36, before the next block is laid to form the first wall face 34. Of course, this applies vice-versa, in that the first block 130 to be laid can be a block for the second wall face 36 followed by a block 130 for the first wall face 34. The blocks 130 can be laid as a complete first course for either of the first and second wall faces 34, 36, followed by a complete course for the other of the first and second wall faces 34, 36. Alternatively, multiple courses, or an entire wall face can be formed for one of the first and second wall faces 34, 36, followed by multiple courses or an entire wall face for the other of the wall faces. In other words, the step of laying a plurality of courses of the first plurality of wall blocks 38 and second plurality of wall blocks 40 may be done sequentially as well as simultaneously.

While laying the initial course of the first plurality of wall blocks 38 on the base course 44, preferably, there is a step of aligning the rear face 134 of the individual blocks 130 with the first edges 76 of the cores 70, 72 of the base blocks 42. Similarly, while stacking the first course of the second plurality of wall blocks 40 on the base course 44, the rear faces 134 of the individual blocks 130 of the second plurality of wall blocks 40 is aligned with the second edges 77 of the cores 70, 72 of the base blocks 42. This helps to lay the initial courses of the first plurality of wall blocks 38 and second plurality of wall blocks 40 in the desired pattern on the base blocks 42.

While laying the plurality of courses of the first plurality of wall blocks 38 and the plurality of courses of the second plurality of wall blocks 40, preferably there is a step of forming the gap 48 between the rear faces 134 of the first plurality of wall blocks 38 and the second plurality of wall blocks 40. After the gap 48 is formed and the first and second wall faces 34, 36 are complete, there may be a step of filling the gap 48 with aggregate filler 104.

After the first wall face 34 and the second wall face 36 are formed, there may be a step of laying a layer of cap blocks 110 so that each cap block 110 covers the top face 136 of a top one of the first plurality of wall blocks 38 and the top face 136 of the top one of the second plurality of wall blocks 40, as well as the gap 48.

Rather than filling the gap 48 with aggregate filler 104, it may be desirable to run wires, cables, lighting, or irrigation, or other desired equipment through the gap 48. After that, the gap 48 can still be filled with aggregate filler 104.

In preferred embodiments, the blocks 130, cap blocks 110, and end construction blocks 162 may be made from dry cast concrete.

In the example first wall face 34 shown in FIG. 3, the blocks 180, 182 of FIGS. 15 and 16 are not used. Of course, there are many embodiments for the wall faces 34, 36. These embodiments can include many different arrangements of blocks 130 including each of the blocks of FIGS. 4-7, 15 and 16; only some of the blocks of FIGS. 4-7, 15 and 16; or only 1 of the blocks of FIGS. 4-7, 15 and 16.

The above are examples. Many embodiments may be made according to the principles provided herein.

What is claimed:

1. A concrete base block especially adapted to be positioned on the ground with other like base blocks to form a base course for a wall; the base block comprising:

(a) a first convex end;

(b) an opposite second concave end sized to receive a first convex end of a like-base block;

(c) first and second sides extending between the first and second ends, the base block having a length between the first and second ends and a width between the first and second sides, the length being greater than the width, the first and second sides being straight over a majority of the length of the base block;

(d) a top face and an opposite bottom face between the first and second ends and the first and second sides; the top face being widest along the portion where the first and second sides are straight, the top face having a generally planar contact surface portion constructed to support a plurality of wall blocks and having no projection extending away from the top face beyond the contact surface portion, the bottom face having a generally planar contact surface constructed to lay flat on the ground and having no projection extending away from the bottom face;

(e) at least one core extending through the block from the top face to the bottom face; and (f) at least first and second handholds formed in the block to permit a human to grasp and lift the block, the first and second handholds comprising first and second hand-receiving indents in the bottom face and corresponding first and second sides of the block; the first hand-receiving indent being along the first side of the block and extending into the first side from the bottom face of the block only partially up the first side of the block; the second hand-receiving indent being along the second side of the block and extending into the second side from the bottom face of the block only partially up the second side of the block; each of the first hand-receiving indent and second hand-receiving indent being sized to allow a user to insert at least a few fingers under each of the first and second sides of the base block when the base block is resting on the bottom face on the ground in order to manipulate the base block and move it into proper position in the base course of the wall to be constructed.

2. The concrete base block of claim 1 wherein the first and second sides are parallel.

3. The concrete base block of claim 2 wherein the at least one core has first and second edges parallel to the first and second sides to provide guides for blocks with straight rear faces which are to be laid on the base block.

4. The concrete base block of claim 3 wherein the at least one core includes two cores, the two cores having their first edges aligned and their second edges aligned.

5. The concrete base block of claim 1 wherein the base block is eleven inches wide.

6. The concrete base block of claim 1 including a plurality of recessed pockets in the bottom face, the recessed pockets being spaced from the first and second sides.

7. The concrete base block of claim 1 wherein the at least one core includes two cores.

8. The concrete base block of claim 1 wherein the first convex end has a radius of curvature of at least 5 inches.

9. The concrete base block of claim 1 wherein the first convex end-has a radius of curvature no greater than 6 inches.

10. The concrete base block of claim 1 wherein the first convex end and the second concave end have the same radius of curvature.

11. The concrete base block of claim 1 wherein the first hand-receiving indent and second hand-receiving indent are centered between the first convex end and second concave end.

12. The concrete base block of claim 1 wherein the first hand-receiving indent and second hand-receiving indent have a height of at least 0.5 inches.

13. The concrete base block of claim 1 wherein the first hand-receiving indent and second hand-receiving indent have a height of no greater than 2 inches along the first and second sides from the bottom face.

14. The concrete base block of claim 1 wherein the at least one core has a width of at least about 1 inch and a length of at least about 1 inch.

15. The concrete base block of claim 1 wherein the first hand-receiving indent and second hand-receiving indent have a rectangular shape.

16. The concrete base block of claim 1 wherein the first hand-receiving indent and second hand-receiving indent have a length of at least 2 inches and no greater than 10 inches.

17. The concrete base block of claim 1 wherein the first hand-receiving indent and second hand-receiving indent have a width of at least 1 inch and no greater than 3 inches.

* * * * *